United States Patent [19]

Ebisawa et al.

[11] Patent Number: 4,727,923

[45] Date of Patent: Mar. 1, 1988

[54] CASTING PROCESS

[75] Inventors: Masuo Ebisawa, Kawagoe; Masaaki Kurosawa; Toshio Hamashima, both of Sakado; Shigeo Kaiho, Oomiya, all of Japan

[73] Assignee: Honda Giken Kogyo Kabushiki Kaisha, Tokyo, Japan

[21] Appl. No.: 798,119

[22] Filed: Nov. 14, 1985

[30] Foreign Application Priority Data

Nov. 21, 1984 [JP] Japan ..... 59-246933

[51] Int. Cl.[4] ..... B22D 17/00

[52] U.S. Cl. ..... 164/113; 164/312

[58] Field of Search ..... 164/113, 312, 313, 314, 164/315, 316, 457, 120

[56] References Cited

U.S. PATENT DOCUMENTS

| | | | |
|---|---|---|---|
| 4,019,561 | 4/1977 | Aoki | 164/314 |
| 4,022,269 | 5/1977 | Segawa | 164/314 |
| 4,147,200 | 4/1979 | Warsinski et al. | 164/314 |
| 4,208,879 | 6/1980 | Segawa | 164/314 |
| 4,330,026 | 5/1982 | Fink | 164/315 |
| 4,413,666 | 11/1983 | Page | 164/113 |

*Primary Examiner*—Nicholas P. Godici
*Assistant Examiner*—Richard K. Seidel
*Attorney, Agent, or Firm*—Roberts, Spiecens & Cohen

[57] ABSTRACT

A casting process which is disclosed herein comprises placing a breakable core into a cavity in a mold and pouring a molten metal under a pressure into the cavity by means of a plunger. The casting process is characterized in that the speed of plunger moved is controlled at three stages of first, second and third velocities, the second velocity being set higher than the first velocity and the third velocity being lower than the second velocity.

8 Claims, 14 Drawing Figures

CASTING PROCESS

BACKGROUND OF THE INVENTION

1. Field of the Invention

The present invention relates to a casting process comprising placing a breakable core into a cavity in a mold and pouring a molten metal under a pressure into the cavity by means of a plunger.

2. Description of the Prior Art

In such conventional casting processes, the speed of movement of the plunger has been controlled to linearly increase with a given ratio of time to distance, and the pressure applied to a molten metal has been controlled to suddenly increase.

However, there are problems which arise in such conventional casting processes. If the speed of the plunger is linearly increased as described above, the molten metal may undergo a wave and include a gas such as air thereinto, so that casting defects such as casting cavities may be produced in the resulting cast product. In addition, if the pressure applied to the molten metal by the plunger is controlled to suddenly increase, the core may be broken under the influence of that pressure.

SUMMARY OF THE INVENTION

It is therefore an object of the present invention to provide a casting process wherein the speed of the plunger is controlled to enable the development of a calm molten metal flow which will not cause the molten metal to from waves.

It is another object of the present invention to provide a casting process wherein the speed of the plunger is controlled to enable the development of a calm molten metal flow which can not cause the molten metal to wave, and the pressure applied to the moltn metal by the plunger is controlled to an extent such that a breakable core will not be broken.

To accomplish the above objects, according to the present invention, there is provided a casting process wherein the speed of the plunger is controlled at three stages of first, second and third velocities, the second velocity being set higher than the first velocity and the third veloscity being lower than the second velocity.

In addition, according to the present invention, there is also provided a casting process wherein the speed of the plunger is controlled at three stages of first, second and third velocities, the second velocity being set higher than the first velocity and the third veloscity being lower than the second velocity, and the pressure applied to the molten metal by the plunger after moving at the third velocity is controlled to a primary level and a secondary level higher than the primary level so that the solidified film of molten metal may be formed on the surface of the core under the primary pressure and the molten metal may be completely silidified under the second pressure.

The control of the speed of the plunger at the three stages as described above prevents the molten metal from waving and provides calm molten metal flow which will not cause a gas such as air to be included thereinto, whereby casting defects such as casting cavities can be prevented from being produced in the resulting cast product.

BRIEF DESCRIPTION OF THE DRAWINGS

The above and other objects, features and advantages of the invention will become apparent from reading the following detailed description of preferred embodiments, taken in conjunction with the accompanying drawings, in which:

FIGS. 1 to 4 illustrate an in-line siamese-type cylinder block, wherein;

FIG.1 is a perspective view of the siamese-type cylinder block taken from above;

FIG. 2 is a sectional view taken along line II—II in FIG. 1;

FIG. 3 is a perspective view of the siamese-type cylinder block taken from below;

FIG. 4 is a sectional view taken along line IV—IV in FIG. 2;

DESCRIPTION OF PREFERRED EMBODIMENTS

Figure 1:
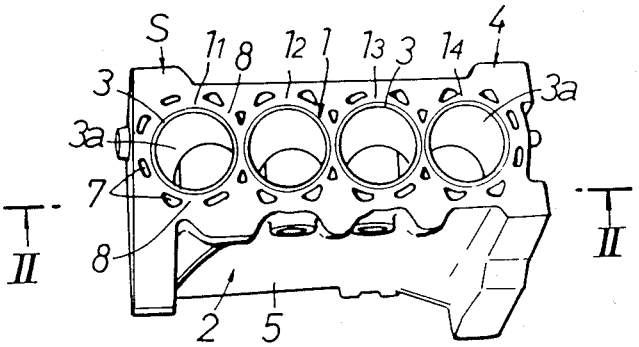
Figure 2:
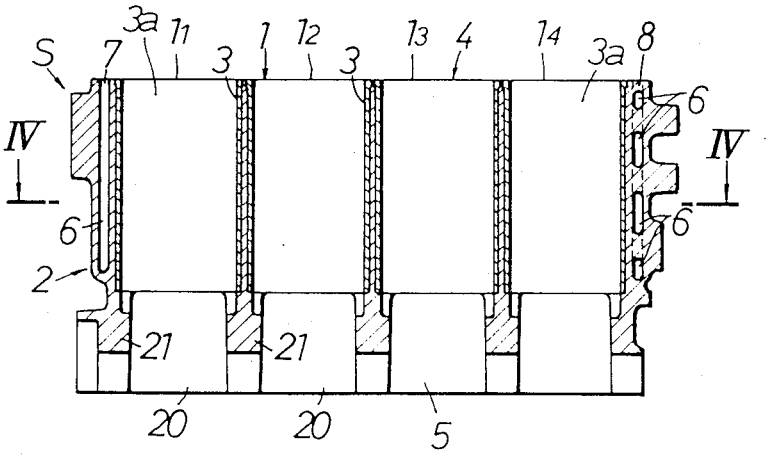

Referring to FIGS. 1 to 4, there is shown an in-line siamese-type cylinder block S obtained according to the present invention. The cylinder block S is comprised of a cylinder block body 2 made of an aluminum alloy and a sleeve 3 made of a cast iron and cast in the body 2. The cylinder block body 2 is constituted of a siamese-type cylinder barrel 1 consisting of a plurality of, e.g., four (in the illustrated embodiment) cylinder barrels $\mathbf{1}_1$ to $\mathbf{1}_4$ connected to one another in series, an outer wall 4 surrounding the siamese-type cylinder barrel 1, and a crankcase 5 connected to the lower edges of the outer wall 4. The sleeve 3 is cast in each the cylinder barrels $\mathbf{1}_1$ to $\mathbf{1}_4$ to define a cylinder bore 3*a*.

A water jacket 6 is defined between the siamese-type cylinder barrel 1 and the outer wall 4, so that the entire periphery of the siamese-type cylinder barrel 1 faces the water jacket 6. At the opening on the cylinder head binding side at the water jacket 6, the siamese-type cylinder barrel 1 is connected with the outer wall 4 by a plurality of reinforcing deck portions 8, and the space between the adjacent reinforcing deck portions 8 functions as a communication port 7 into a cylinder head. Thereupon, the cylinder block S is constituted into a closed deck type.

Figure 5:
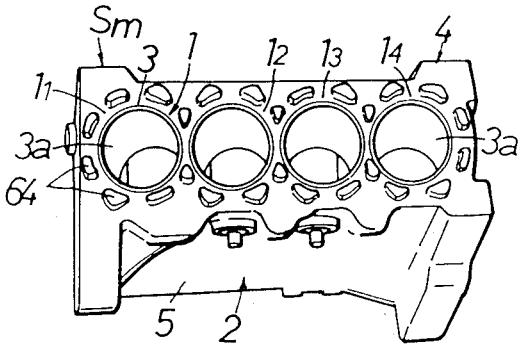
FIG. 5 is a perspective view of a siamese-type cylinder block blank produced according to the present invention, from above.
Figure 3:
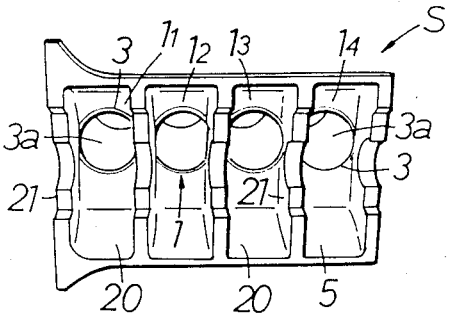
Figure 4:
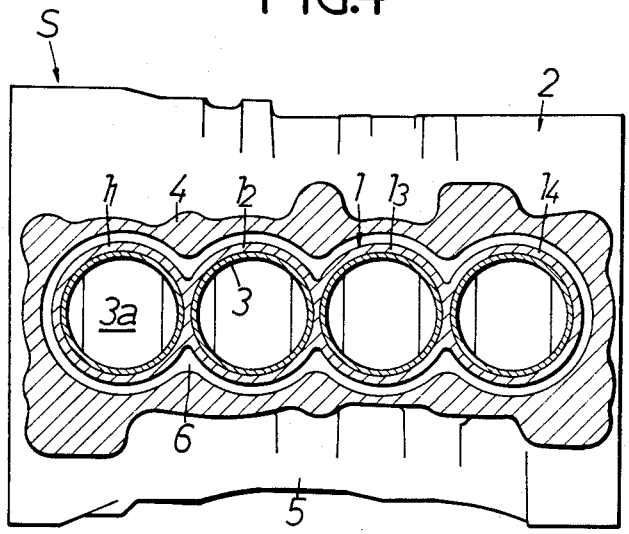

Referring to FIGS. 6 to 10, there is shown an apparatus for casting a cylinder block blank Sm shown in FIG. 5, which apparatus comprises a mold M as a casting mold. The mold M is constituted of a liftable upper die 9, first and second laterally split side dies $10_1$ and $10_2$ (see FIGS. 6 and 7) disposed under the upper die 9, and a lower die 11 on which both the side dies $10_1$ and $10_2$ are slidably disposed.

Figure 7:
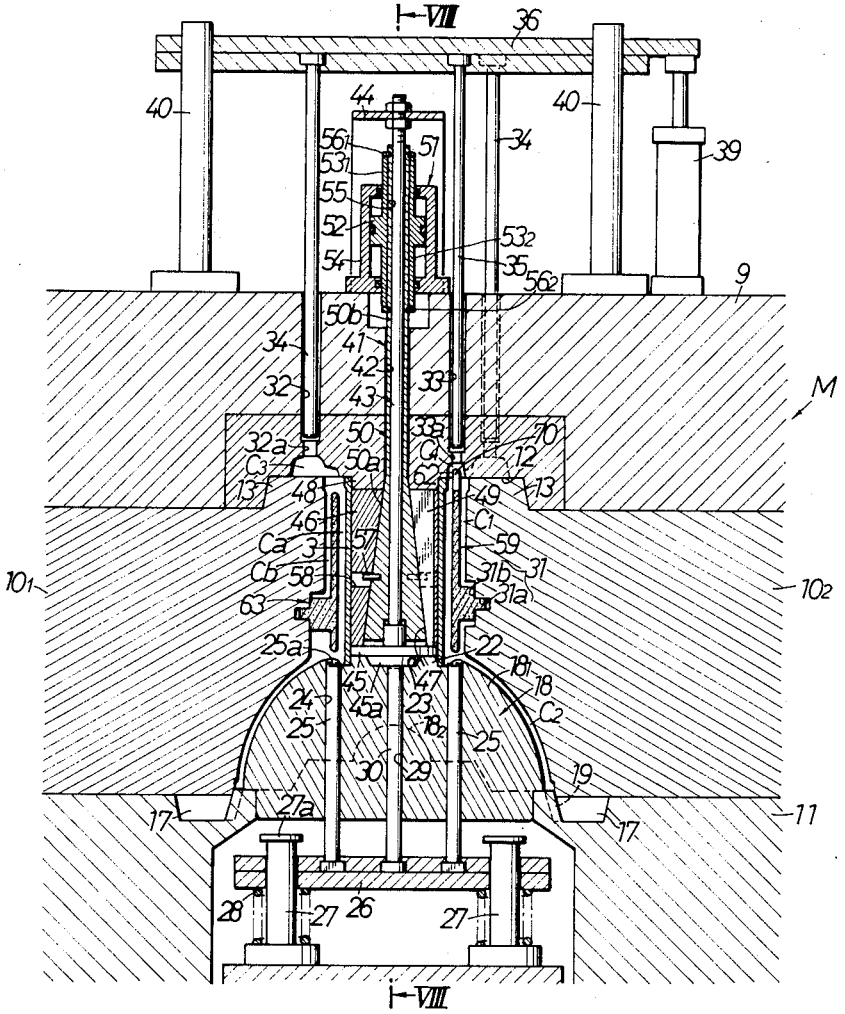
FIG. 7 is a front view in vertical section of the casting apparatus when the mold is closed.

A clamping recess 12 is formed on the underside of the upper die 9 to define the upper surface of a first cavity C1, and a clamping projection 13 adapted to be fitted in the recess 12 is provided on each the side dies $10_1$ and $10_2$. The first cavity C1 consists of a siamese-type cylinder barrel molding cavity Ca defined between a water-jacket molding sand core 59 as a breakable core and an expansion shell 46, and an outer wall molding cavity Cb defined between the sand core 59 and both the side dies $10_1$ and $10_2$, in the clamped condition as shown in FIG. 7.

Figure 8:
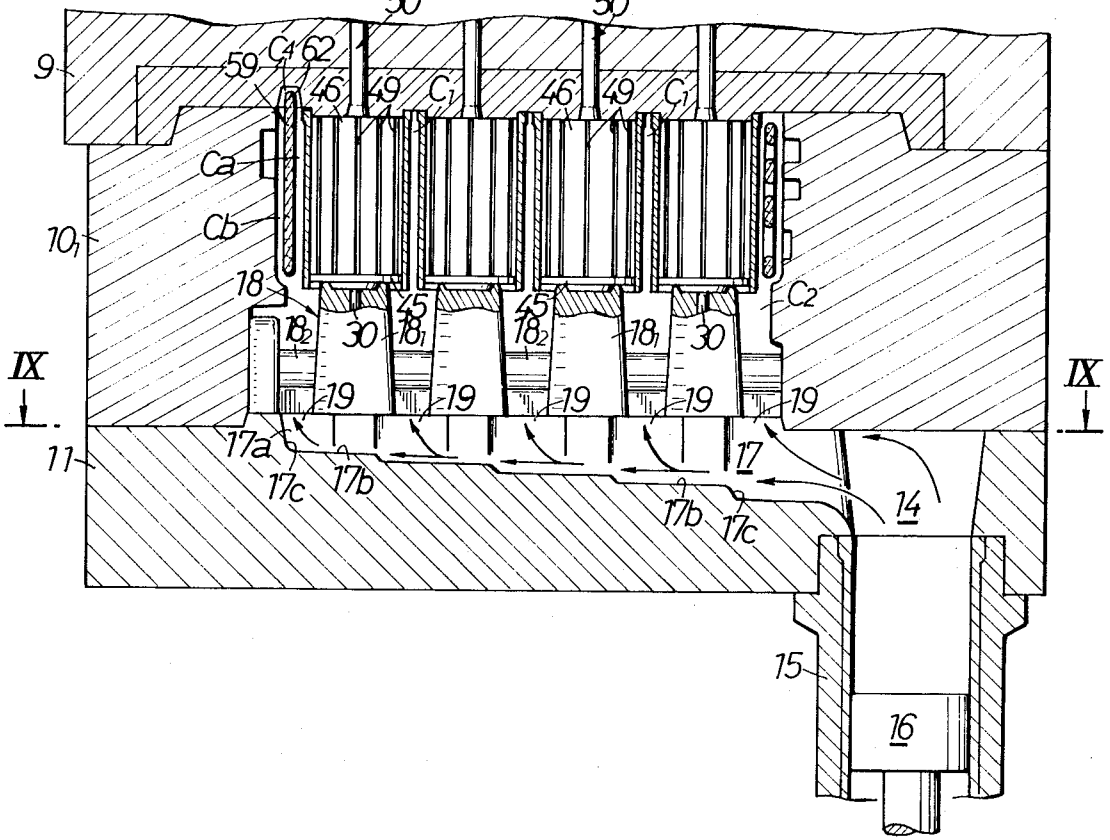
FIG. 8 is a sectional view taken along line VIII—VIII in FIG. 7.
Figure 9:
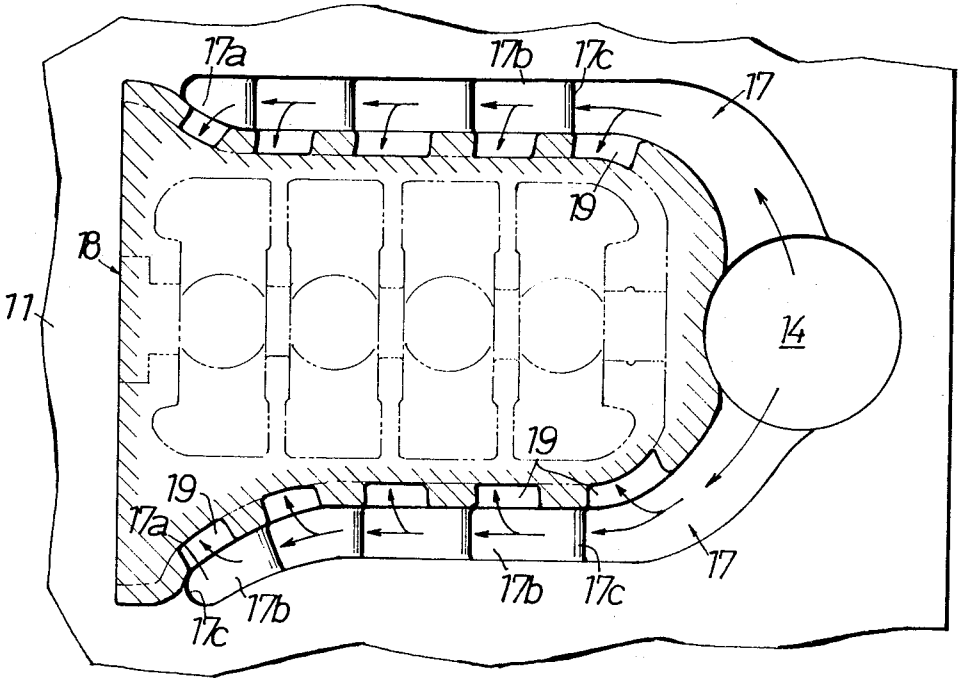
FIG. 9 is a sectional view taken along the line IX—IX in FIG. 8.

As shown in FIGS. 8 and 9, the lower die 11 includes a basin 14 for receiving a molten metal of aluminum alloy from a furnace (not shown), a pouring cylinder 15 communicating with the basin 14, a plunger 16 slidably fitted in the pouring cylinder 15, and a pair of runners 17 bifurcated from the basin 14 to extend in the direction of the cylinder barrels. The lower die 11 also has a molding block 18 projecting upwardly between both of the runners 17, and the molding block 18 defines a second cavity C2 for molding the crankcase 5 in cooperation with both the side dies $10_1$ and $10_2$. The cavity C2 is in communication at its upper end with the first cavity C1 and at its lower end with both the runners 17 through a plurality of gates 19.

The molding block 18 is comprised of four first taller semicolumnar molding portions $18_1$ formed at predetermined intervals, and second protruded molding portions $18_2$ located between adjacent first molding portions $18_1$ and outside both of the outermost first molding portions $18_1$. Each first molding portion $18_1$ is used for molding a space 20 (see FIGS. 2 and 3) in which a crankpin and a crankarm are rotated, and each second molding portion $18_2$ is employed to mold a crank journal bearing holder 21 (see FIGS. 2 and 3). Each gate 19 is provided to correspond to each of the second molding portions $18_2$ and designed to permit the charging or pouring of a molten metal in the larger volume of the second cavity C2 in an early stage.

Both the runners 17 are defined with their bottom surfaces stepped in several ascending stairs to stepwise decrease in sectional area from the basin 14 toward runner extensions 17*a*. Each riser portion 17*c* connected to each stepped portion 17*b* is angularly formed to be able to smoothly guide molten metal into each of the gates 19.

With the sectional area of the runner 17 decreasing stepwise in this manner, a larger amount of molten metal can be charged or poured, at the portion larger in sectional area, into the second cavity C2 through the gate 19 at a slower speed, and at the portion smaller in sectional area, into the second cavity through the gate 19 at a faster speed, so that the molten metal level in the cavity C2 raises substantially equally over the entire length of the cavity C2 from the lower ends on the opposite sides thereof. Therefore, the molten metal will not produce any turbulent flow and thus, a gas such as air can be prevented from being included into the molten metal to avoid the generation of mold cavities. In addition, a molten metal pouring operation is effectively conducted, leading to an improved casting efficiency.

Figure 6:
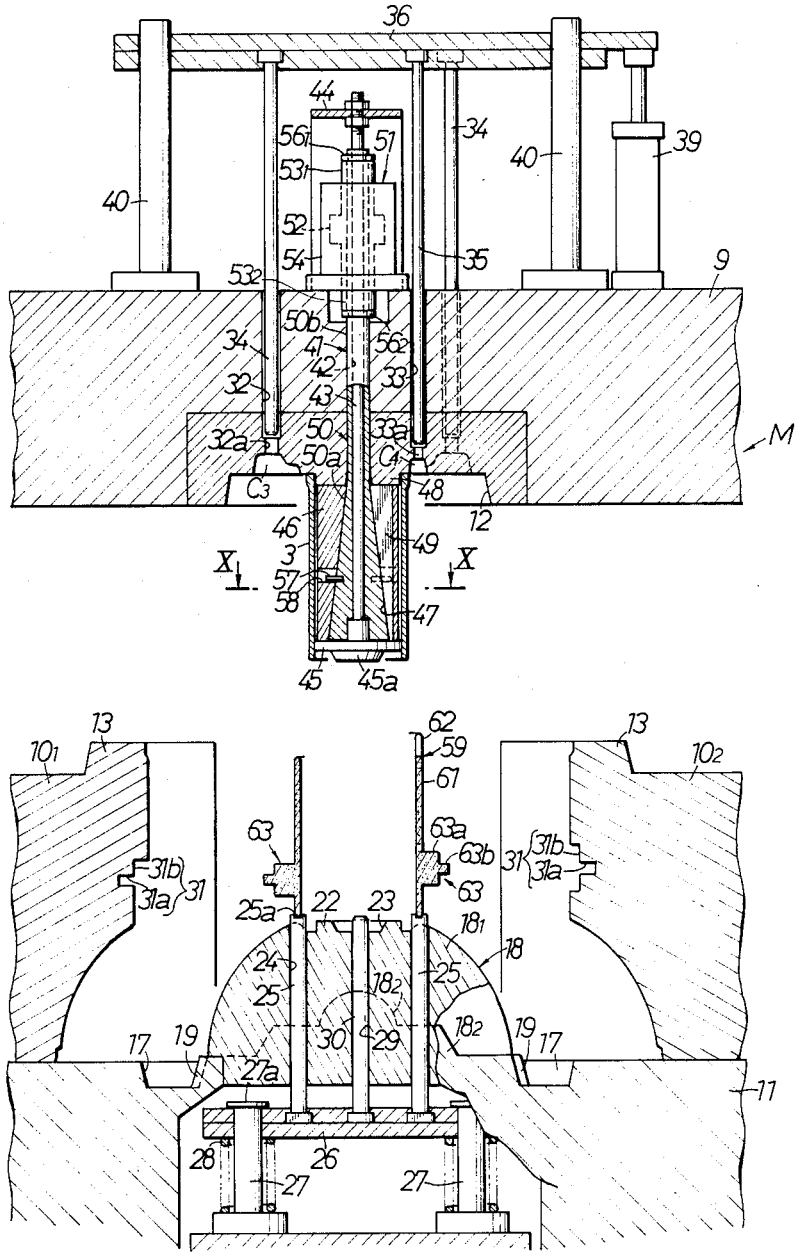
FIG. 6 is a front view in vertical section of a casting apparatus when a mold is open.

As shown in FIGS. 6 and 7, a locating projection 22 is provided on the top of each of the first molding portions $18_1$ and adapted to be fitted in the circumferential surface of the sleeve 3 of cast iron, and a recess 23 is defined at the central portion of the locating projection 22. A through hole 24 is made in each of two first molding portions $18_1$ located on the opposite sides to penetrate the first molding portion $18_1$ on each of the opposite sides of the locating projection 22. A pair of temporary placing pins 25 are slidably fitted in the through holes 24, respectively, and are used to temporarily place the water-jacket molding sand core 59. The lower ends of the temporary placing pins 25 are fixed on a mounting plate 26 disposed below the molding block 18. Two support rods 27 are inserted through the mounting plate 26, and a coil spring 28 is provided in compression between the lower portion of each the support rods 27 and the lower surface of the mounting plate 26. During opening of the mold, the mounting plate 26 is subjected to the resilient force of each of the coil springs 28 to move up until it abuts against the stopper 27*a* on the fore end of each the support rods 27. This causes the fore end of each of the temporarily placing pins 25 to protrude from the top surface of the first molding portion $18_1$. A recess 25*a* is made in the fore end of each the placing pins 25 and adapted to be engaged by the lower edge of the sand core.

A through hole 29 is made between the two first molding portions $18_1$ located on the opposite sides at the middle between both the through holes 24, and an operating pin 30 is slidably fitted in the through hole 29. The lower end of the operating pin 30 is fixed to the mounting plate 26. During opening the mold, the fore end of the operating pin 30 protrudes into the recess 23, and during closing the mold, it is pushed down by an expanding mechanism 41, thereby retracting both the placing pins 25 from the top surfaces of the first molding portions $18_1$.

A core bedding recess 31 for the sand core 59 is provided at two places: in the central portions of those walls of the first and second side dies $10_1$ and $10_2$ defining the second cavity C2. Each of the core bedding recesses 31 consists of an engaging bore 31*a* in which the sand core is positioned, and a clamp surface 31*b* formed around the outer periphery of the opening of the engaging bore 31*a* for clamping the sand core.

In the clamping recess 12 of the upper die 9 there are provided a plurality of third cavities C3 opened into the first cavity C1 to permit the overflow of molten metal and a plurality of fourth cavities C4 for shaping the communication holes 7. The upper die 9 also has gas vent holes 32 and 33 made therein which communicate with each of the third cavities C3 and each of the fourth cavities C4, respectively.

Closing pins 34 and 35 are inserted into the gas vent holes 32 and 33, respectively, and are fixed at their upper ends to a mounting plate 36 disposed above the upper die 9.

The gas vent holes 32 and 33 have smaller diameter portions 32*a* and 33*a*, respectively, which extend upwardly a predetermined length from the respective ends, of the gas vent holes 32 and 33, communicating with the cavities C3 and C4, and which are fitted with the corresponding closing pins 34 and 35 so that the third and fourth cavities C3 and C4 may be closed.

A hydraulic cylinder 39 is disposed between the upper surface of the upper die 9 and the mounting plate 36 and operates to move the mounting plate 36 upwardly or downwardly, thereby causing the individual closing pins 34 and 35 to close the corresponding smaller diameter portions 32*a* and 33*a*. Reference numeral 40 designates a rod for guiding the mounting plate 36.

The expanding mechanism 41, which is provided in the upper die 9 for applying an expansion force to the sleeve 3 cast in each the cylinder barrels $1_1$ to $1_4$, is constituted in the following manner.

A through hole 42 is provided in the upper die 9 with its center line aligned with the axis extension of the operating pin 30, and a support rod 43 is loosely inserted into the through hole 42. The support rod 43 is fixed at its upper end to a bracket 44 on the upper surface of the upper die 9, and has as a sealing member a plate 45 secured at its lower end for blocking the entry of a molten metal. The blocking plate 45 is formed on its lower surface with a projection 45a which is fittable in the recess 23 at the top of the first molding portion $18_1$.

Figure 10:
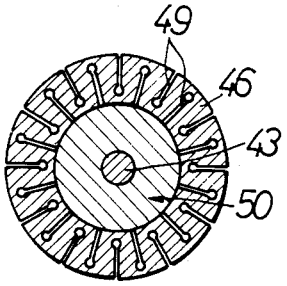
FIG. 10 is a sectional view taken along line X—X in FIG. 6.

The hollow expansion shell 46 has a circular outer peripheral surface and a tapered hole 47 having a downward slope from the upper portion toward the lower portion. The lower portion of the support rod 43 projecting downwardly from the upper die 9 is loosely inserted into the tapered hole 47 of the expansion shell 46 whose upper end surface bears against a projection 48 projecting as a sealing member on the recess 12 of the upper die 9 and whose lower end surface is carried on the blocking plate 45. As shown in FIG. 10, a plurality of slit grooves 49 are formed in the peripheral wall of the expansion shell 46 at circumferentially even intervals to radially extend alternately from the inner and the outer peripheral surfaces of the expansion shell 46.

A hollow operating or actuating rod 50 is slidably fitted on the support rod 43 substantially over its entire length for expanding the expansion shell 46, and is comprised of a frustoconical portion 50*a* adapted to be fitted in the tapered hole 47 of the expansion shell 46, and a circular portion 50*b* continuously connected to the frustoconical portion 50*a* so as to be slidably fitted in the through hole 42 and projecting from the upper die 9. A plurality of pins 57 project from the frustoconical portion 50*a* and are each inserted into a vertically long pin hole 58 of the expansion shell 46 to prevent the expansion shell 46 from being rotated while permitting the vertical movement of the frustoconical portion 50*a*.

A hydraulic cylinder 51 is fixedly mounted on the upper surface of the upper die 9 and contains a hollow piston 52 therein. Hollow piston rods $53_1$ and $53_2$ are mounted on the upper and lower end surfaces of the hollow piston 52 and project thereform to penetrate the upper and lower end walls of a cylinder body 54, respectively. The circular portion 50*b* of the operating rod 50 is inserted into a through hole formed in the hollow piston 52 and the hollow piston rods $53_1$ and $53_2$, and antislip-off stoppers $56_1$ and $52_2$ each fitted in an annular groove of the circualr portion 50*b* is mounted to bear against the upper end surface of the hollow piston rod $53_1$ and the lower end surface of the hollow piston rod $53_2$, respectively, so that the hollow piston 52 causes the operating rod 50 to be moved up or down. The four expanding mechanisms 41 may be provided to correspond to the individual cylinder barrels $1_1$ to $1_4$ of the cylinder block S, respectively.

Figure 11:
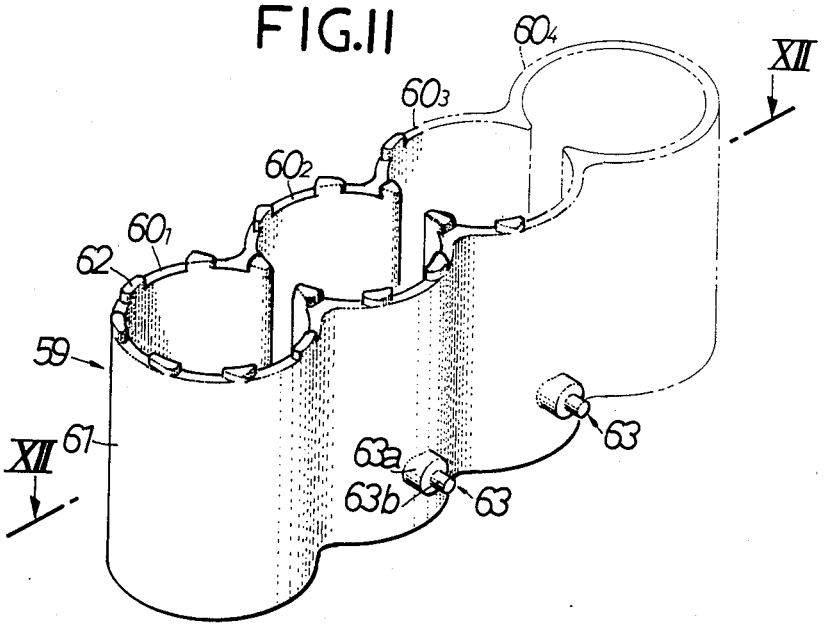
FIG. 11 is a perspective view of a sand core, taken from above.
Figure 12:
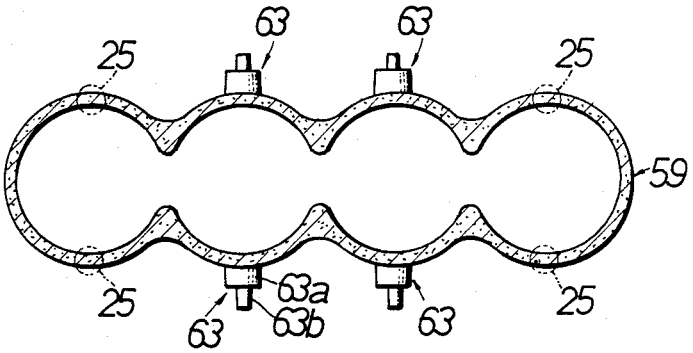
FIG. 12 is a sectional view taken along line XII—XII in FIG. 11.

FIGS. 11 and 12 show the water-jacket molding sand core 59 which is constituted of a core body 61 comprising four cylindrical portions $60_1$ to $60_4$ corresponding to the four cylinder barrels $1_1$ to $1_4$ of the cylinder block S with the peripheral interconnecting walls of the adjacent cylindrical portions being eliminated, a plurality of projections 62 formed on the end surface of the core body 61 on the cylinder head mounting side to define the communication ports 7 for permitting the communication of the water jacket 6 with the water jacket of the cylinder head, and a core print 63 protruding on the opposite (in the direction of the cylinder barrels) outer side surfaces of the core body 61, e.g., on the opposite outer side surfaces of two cylindrical portions $60_2$ and $60_3$ located between the outermost ones in the illustrated embodiment. Each of the core prints 63 is formed with a larger diameter portion 63*a* integral with the core body 61, and a smaller diameter portion 63*b* on the end surface of the larger diameter portion 63*a*. In this case, the projection 62 is sized to be loosely fitted in the aforesaid fourth cavity C4. The sand core 59 is formed, for example, using a resin-coated sand.

Description will now be made of the operation of casting a cylinder block blank Sm in the above casting apparatus.

First, as shown in FIG. 6, the upper die 9 is moved up and both the side dies $10_1$ and $10_2$ are moved away from each other, thus achieving opening of the mold. In the expanding mechanism 41, each hydraulic cylinder 51 is operated to cause the hollow piston 52 to move the operating rod 50 downwardly, so that the downward movement of the frustoconical portion 50*a* allows the expansion shell 46 to be contracted. In addition, the hydraulic cylinder 39 of the upper die 9 is operated to move the mounting plate 36 up. This causes the individual closing pins 34 and 35 to be released from the corresponding smaller diameter portions 32*a* and 33*a* respectively communicating with the third and fourth cavities C3 and C4. Further, the plunger 16 in the pouring cylinder 15 is moved down.

The substantially circular sleeve 3 of cast iron is loosely fitted in each expansion shell 46, and the opening at the upper end of the sleeve 3 is fitted and closed by the projection 48 of the upper die 9. The end surface of the sleeve 3 is aligned with the lower end surface of the projection 45*a* on the blocking plate 45, while the opening at the lower end of the sleeve 3 is closed by the blocking plate 45. The hydraulic cylinder 51 of the expanding mechanism 41 is operated to cause the hollow piston 52 therein to lift the operating rod 50. The frustoconical portion 50*a* is thereby moved upwardly, so that the expansion shell 46 is expanded. Thereupon, the sleeve 3 is subjected to an expansion force and thus reliably held on the expansion shell 46.

As shown in Figs.6 and 12, the lower edges of the cylindrical portions $60_1$ and $60_4$ on the outermost opposite sides in the sand core 59 are each engaged in the recess 25*a* of each placing pin 25 projecting from the top of each the first molding portions $18_1$ on the opposite sides in the lower die 11, thereby temporarily placing the sand core 59.

The side dies $10_1$ and $10_2$ are moved a predetermined distance toward each other to engage each core bedding recess 31 with each core print 63, thus securely placing the sand core 59. More specifically, the smaller diameter portion 63*b* of each of the core prints 63 in the sand core 59 is fitted into the engaging hole 31*a* of each the core bedding recesses 31 to position the sand core 59, with the end surface of each of the larger diameter portions 63*a* being mated with the clamping surface 31*b* of each core bedding recess 31 to clamp the sand core 59 by the clamping surface 31*b*.

As shown in FIG. 7, the upper die 9 is moved down to insert each of the sleeves 3 into each the cylindrical portions $60_1$ to $60_4$ of the sand core 59, and the projection 45*a* of the molten metal-entering blocking plate 45 is fitted into the recess 23 at the top of the first molding portion $18_1$. This causes the projection 45*a* of the blocking plate 45 to push down the operating rod 30, so that each of the placing pins 25 is moved down and retracted from the top surface of the first molding portion $18_1$. In addition, the clamping recesses 12 of the upper die 9 are fitted with the clamping projections 13 of both the side dies $10_1$ and $10_2$, thus effecting the clamping of the mold. This downward movement of the upper die 9 causes the projection 62 of the sand core 59 to be loosely inserted into the fourth cavity C4, whereby a space is defined around the projection 62. A space 70 for shaping the reinforcing deck portion 8 is also defined between the end surface of the sand core 59 and the inner surface of the recess 12 opposed to such end surface.

A molten metal of aluminum alloy is supplied from a furnace into the basin 14 of the lower die 11, and the plunger 16 is moved up to pass the molten metal through both the runners 17 and pour it into the second cavities C2 and the first cavities C1 from the opposite lower edges of the second cavities C2 via the gates 19. The application of this bottom pouring process allows a gas such as air in both the cavities C1 and C2 to be forced up by the molten metal and vented upwardly from the upper die 9 via the gas vent holes 32 and 33 in communication with the third and fourth cavities C3 and C4.

In the present case, both the runners 17 have the runner bottom stepped with several upward stairs from the basin 14 so that the sectional area decreases stepwise toward the runner extensions 17*a* as described above and hence, the upward movement of the plunger 16 causes the molten metal to be passed from both the runners 17 through the gates 19 and to smoothly rise in the second cavities C2 substantially uniformly over the entire length thereof from the lower ends of the opposite sides thereof. Thus, the molten metal can not produce a turbulent flow in both the cavities C1 and C2, and a gas such as air can be prevented from being included into the molten metal to avoid the generation of any mold cavity.

After the molten metal has been poured in the third and fourth cavities C3 and C4, the hydraulic cylinder 39 on the upper die 9 is operated to move the mounting plate down, thereby causing the closing pins 34 and 35 to close the smaller diameter portions 32*a* and 33*a* communicating with the cavities C3 and C4, respectively.

Figure 13:
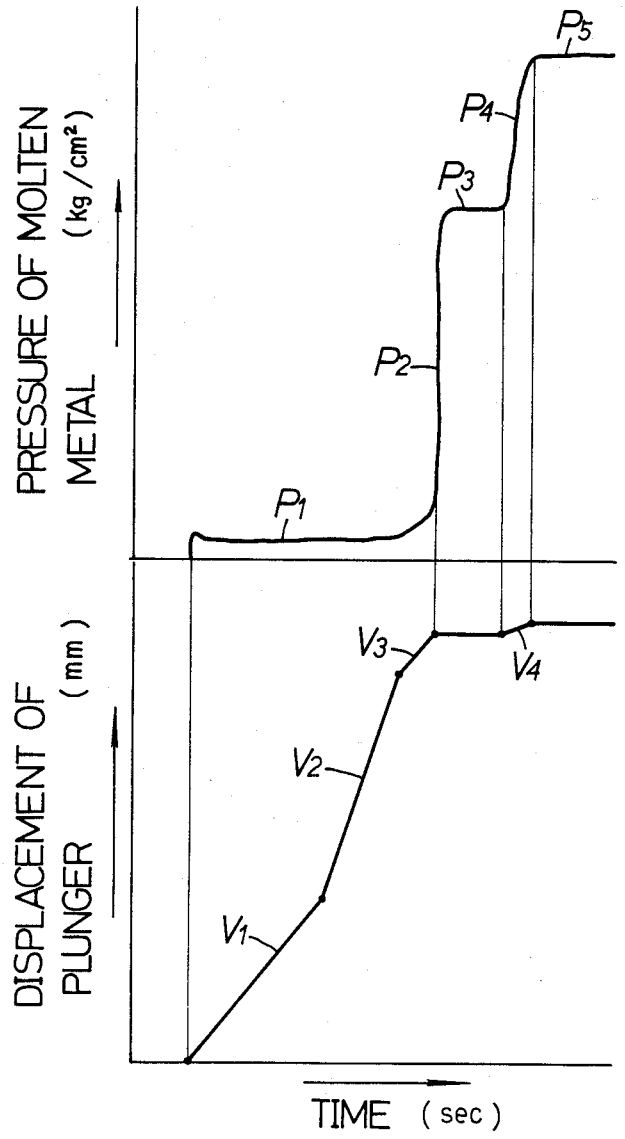
FIG. 13 is a graph illustrating the relationship between time and displacement of a plunger and the relationship between time and pressure applied to a molten metal.

In the above pouring operation, the displacement of the plunger 16 for pouring the molten metal into the second and first cavities C2 and C1 and the pressure applied to the molten metal are controlled as shown in FIG. 13.

More specifically, the speed of the plunger 16 is controlled in three stages at first to third velocities V1 to V3. In the present embodiment, the third velocity V1 is set at 0.08–0.12 m/sec., the second velocity V2 is at 0.14–0.18 m/sec., and the third velocity V3 is at 0.04–0.08 m/sec. to give a substantial deceleration. This control in velocity at three stages prevents waving of the molten metal and produces a calm molten metal flow which can not include a gas such as air thereinto, so that the molten metal can be poured into both the cavities C2 and C1 with good efficiency.

At the first velocity V1 of the plunger 16, the molten metal merely fills both the runners 17 and hence, the pressure P1 of the molten metal is kept substantially constant. At the second and third velocities V2 and V3 of the plunger 16, the molten metal is poured or charged into both the cavities C1 and C2 and therefore, the pressure P2 of the molten metal rapidly increases. After the plunger 16 has been moved at the third velocity V3 for a predetermined period of time, the pressure, i.e., primary pressure P3 of the molten metal is maintained at 150–400 kg/cm$^2$ for a period of about 1.5 seconds, whereby the sand core 59 is completely enveloped in the molten metal to form a solidified film of molten metal on the surface thereof.

After lapse of the above time, the plunger 16 is deceleratively moved at the velocity V4, so that the pressure P4 of the molten metal increases. When the pressure, i.e., secondary pressure P5 has reached a level of 200–600 kg/cm$^2$, the movement of the plunger 16 is stopped, and under this condition, the molten metal is solidified.

If the solidified film of molten metal is formed on the surface of the sand core 59 under the primary pressure, as described above, the sand core 59 can be protected under the subsequent secondary pressure by the film against breaking. In addition, the sand core 59 is expanded due to the molten metal, but because the projection 62 is loosely inserted in the fourth cavity C4, it follows the expansion of the sand core 59, whereby folding of the projection 62 is avoided.

Since the sand core 59 is clamped in an accurate position by both the side dies $10_1$ and $10_2$ through each the core prints 63, it can not float up during the pouring of the molten metal into the first cavities C1 and during the pressing the molten metal in the cavities C1. In addition, since the end surface of the larger diameter portion 63*a* of each core print 63 mates with the clamping surface 31*b*, as the sand core 59 is being expanded, the deforming force thereof is suppressed by each of the clamping surfaces 31b to prevent the deformation of the sand core 59. Thus, a siamese-type cylinder barrel 1 is provided having a uniform thickness around each of the sleeves 3.

As discussed above, a closed deck-type cylinder block blank can be cast with substantially the same production efficiency as in a die casting process, by controlling the speed of plunger 16 and the pressure of the molten metal.

After the completion of solidification of the molten metal, the hydraulic cylinder 51 of the expanding mechanism 41 is operated to move the operating rod 50 down, thereby eliminating the expansion force of the expansion shell 46 on the sleeve 3. The mold is opened to give a cylinder block blank Sm as shown in FIG. 5.

The projecting portions 64 (FIG. 5) each including the projection 62 of the sand core 59 is cut away from the above cylinder block Sm to provide the communication holes 7 in the areas occupied by the projections 62 and to form the reinforcing deck portions 8 between the adjacent communication holes 7. Thereafter, the extraction of sand is conducted to povide the water jacket 6. Further, the inner peripheral surface of each sleeve 3 is worked to form a true circle, and another predetermined working is effected to give a cylinder block S as shown in FIGS. 1 to 4.

Figure 14:
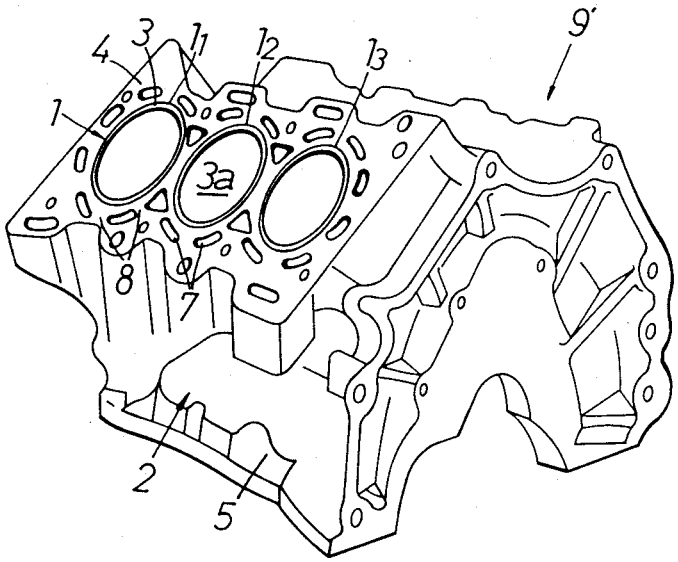
FIG. 14 is a perspective view of a V-shaped siamese-type cylinder block, taken from above.

FIG. 14 shows a V-shaped siamese-type cylinder block S' including two siamese-type cylinder barrels 1. The cylinder block S' is also made through a similar casting and working steps as described above. In this Figure, the same reference characters are used to designate the same parts as in the above first illustrated embodiment.

What is claimed is:

1. A casting process comprising placing a breakable core into a cavity in a mold and pouring a molten metal into said cavity under a pressure by means of a plunger, wherein the speed of displacement of said plunger is controlled at three states of first, second and third velocities, said second velocity being higher than said first velocity and said third velocity being lower than said second velocity, and wherein the pressure applied to the molten metal by said plunger after its complete displacement at said third velocity is controlled to a primary pressure and a secondary pressure higher than said primary pressure, so that a solidified film of molten metal is formed on the surface of said core to surround said core under said primary pressure and the molten metal is completely solidified under the secondary pressure, the magnitude of said primary pressure and its time of application being related to the breakable core to achieve the formation of said solidified film of molten metal on the surface of said core and enable said core to resist the subsequent application of the higher secondary pressure and prevent breakage of the core.

2. A casting process according to claim 1, wherein said first velocity is 0.08–0.12 m/sec, said second velocity is 0.14–0.18 m/sec and said third velocity is 0.04–0.08 m/sec, and wherein said primary pressure is 150–400 kg/cm$^2$ and said secondary pressure is 200–600 kg/cm$^2$.

3. A casting process according to claim 1 or 8, wherein said breakable core is a sand core.

4. A casting process according to claim 3, wherein said sand core is formed from a resin-coated sand.

5. A casting process according to claim 1 wherein a runner is provided in communication with said cavity of the mold and during the initial stage of first velocity of said plunger, the molten metal is introduced into said runner and during subsequent stages of second and third velocities the molten metal is charged into the mold cavity.

6. A casting process according to claim 1 wherein said mold has a plurality of cavities arranged therein adjacent and in alignment with each other and a pair of runners extend on opposite sides of the mold in the direction of the cavities to connect the cavities with a basin which is located at one end of the cavities, the pair of runners having bottom surfaces ascending stepwise toward the other end of the cavities, whereby the molten metal is introduced from the basin into the runners at the initial stage of low first velocity of the plunger and is thereafter charged into the plurality of cavities substantially in a uniform distribution during the subsequent second and third velocity stages.

7. A casting process according to claim 6 wherein each of the runners has several ascending steps toward the other end of the cavities to form stepwise decreasing sectional flow areas from said basin.

8. A casting process according to claim 1 wherein a runner is provided to connect said mold cavity with a basin and wherein during the first velocity stage of displacement of the plunger, the molten metal is introduced into said runner from the basin; during the subsequent second and third velocity stages the molten metal is charged into the cavity; and during the stages of application of the primary and secondary pressures, the charged molten metal is solidified into the desired shape.

* * * * *

UNITED STATES PATENT AND TRADEMARK OFFICE

CERTIFICATE OF CORRECTION

PATENT NO. : 4,727,923

DATED : March 1, 1988

INVENTOR(S) : Ebisawa et al.

It is certified that error appears in the above—identified patent and that said Letters Patent is hereby corrected as shown below:

Claim 3 should be dependent on claims 1 or 2.

Signed and Sealed this

Thirty-first Day of January, 1989

*Attest:*

DONALD J. QUIGG

*Attesting Officer*

*Commissioner of Patents and Trademarks*